United States Patent [19]

Dörrie et al.

[11] Patent Number: 5,061,942

[45] Date of Patent: Oct. 29, 1991

[54] ROD-SHAPED TRANSCEIVER ANTENNA ESPECIALLY FOR 450–470 MHZ BAND

[75] Inventors: Horst Dörrie; Uwe Militz, both of Berlin, Fed. Rep. of Germany

[73] Assignee: Robert Bosch GmbH, Stuttgart, Fed. Rep. of Germany

[21] Appl. No.: 540,339

[22] Filed: Jun. 19, 1990

[30] Foreign Application Priority Data

Jun. 19, 1989 [DE] Fed. Rep. of Germany ..... 3919884

[51] Int. Cl.[5] ..... H01Q 9/32; H01Q 11/08

[52] U.S. Cl. ..... 343/749; 343/843; 343/895; 343/900

[58] Field of Search ..... 343/749, 895, 888, 825, 343/827, 702, 843, 900

[56] References Cited

U.S. PATENT DOCUMENTS

| | | | |
|---|---|---|---|
| 4,101,898 | 7/1978 | Ingram | 343/895 |
| 4,161,737 | 7/1979 | Albright | 343/895. |
| 4,163,981 | 8/1979 | Wilson | 343/895 |
| 4,490,727 | 12/1984 | Kowols | 343/895 |

*Primary Examiner*—Michael C. Wimer

*Attorney, Agent, or Firm*—Frishauf, Holtz, Goodman & Woodward

[57] ABSTRACT

An improved transceiver antenna is designed for mounting on vehicles where, for aerodynamic reasons, vertical orientation is undesirable. It is an object of the present invention to provide a high-gain antenna which, even when mounted at a declination of up to 40° from the vertical, maintains the most smoothly curved possible antenna characteristic. This is achieved by winding four serially connected coils (SP1–SP4) on a rod (12) of dielectric material, with the third coil reverse-wound with respect to the second, with a radiating element (13) connected to the free end of the fourth coil, the lengths of the coils and radiating element being selected to be, respectively, $\frac{1}{4}$, $\frac{1}{4}$, $\frac{1}{8}$, $\frac{1}{8}$, and $\frac{3}{8}$ of the median wavelength. Upon mounting at an angle of 40° to the vertical, this antenna has an optimal antenna characteristic curve. The antenna is particularly well adapted for use in the frequency band 450 to 470 MHz, which in Germany is assigned by the German Federal Postal Administration to Network C.

29 Claims, 1 Drawing Sheet

Fig. 1
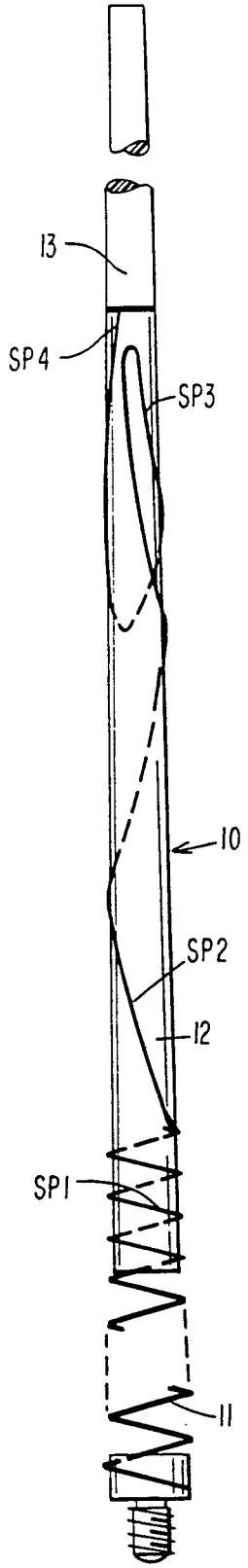
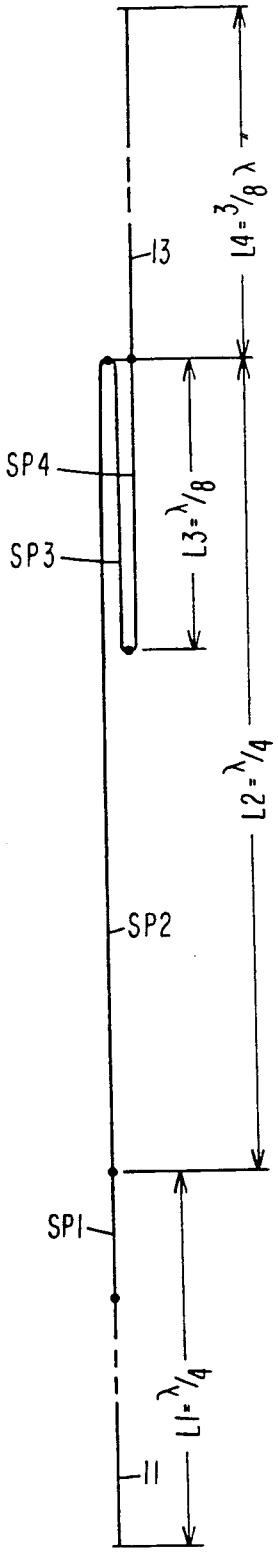
Fig. 2
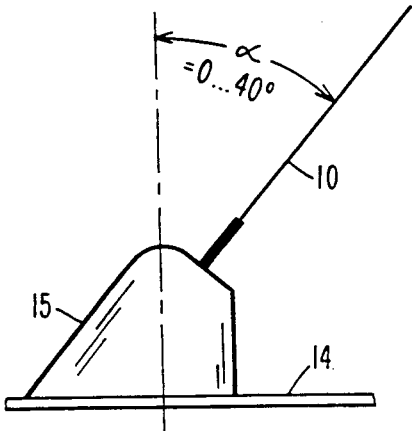
Fig. 3

ROD-SHAPED TRANSCEIVER ANTENNA ESPECIALLY FOR 450–470 MHZ BAND

Cross-reference to related applications and patents, the disclosures of which are incorporated by reference: Dörrie & Klinkwitz, U.S. Pat. No. 4,375,642, Mar. 1, 1983; Dörrie & Militz, U.S. Ser. No. 07/448,750, filed Dec. 11, 1989; Dörrie & Militz, U.S. Ser. No. 07/460,743, filed Jan. 4, 1990.

FIELD OF THE INVENTION

The invention relates generally to high-frequency antennas and, more particularly, to transceiver antennas for mounting on vehicles where, for aerodynamic reasons, vertical orientation is undesirable.

BACKGROUND

A rod-shaped antenna is known, which has the disadvantage that, when it is mounted at a less-than-vertical angle, the round-off characteristic is no longer a smooth curve, but rather has sharp irregularities of up to 30 dB.

THE INVENTION

Accordingly, it is an object of the present invention to provide a high-gain antenna which, even when mounted at a declination of up to 40° from the vertical, maintains the most smoothly curved possible antenna characteristic.

Briefly, this is achieved by winding four serially connected coils on a rod of dielectric material, with the third coil reverse-wound with respect to the second, with a radiating element connected to the free end of the fourth coil, the lengths of the coils and radiating element being selected to be, respectively, $\frac{1}{4}$, $\frac{1}{4}$, $\frac{1}{8}$, $\frac{1}{8}$, and $\frac{3}{8}$ of the median wavelength. Upon mounting at an angle of 40° to the vertical, this antenna has an optimal antenna characteristic curve.

The antenna is particularly well adapted for use in the frequency band 450 to 470 MHz, which in Germany is assigned by the German Federal Postal Administration to Network C.

DRAWINGS

A preferred embodiment is illustrated in the figures, of which

FIG. 1 is an enlarged, longitudinal, part-sectional view of the rod-shaped antenna of the present invention;

FIG. 2 is a winding diagram of the antenna of FIG. 1; and

FIG. 3 is a side view of an antenna mounted on a vehicle.

DETAILED DESCRIPTION

FIG. 1 illustrates a rod-shaped antenna 10 with a flexible, electrically conductive spring element 11, preferably a through-conductive spiral spring. One end of spring 11 is connected to the base of an elastic rod 12 of dielectric material. Rod 12 supports a first coil SP1 which is electrically connected with flexible spring element 11. A first length L1 of antenna 10 consists of the flexible spring element 11 and coil SP1.

Adjacent first length L1 is a second length L2 of rod 12, which supports several coils (compare FIGS. 1 and 2), including a second coil SP2 which extends over the entire length L2 and which is connected to the base-remote end of first coil SP1.

A third coil SP3, having a third length L3 within L2, is connected to the base-remote end of second coil SP2, but is reverse-wound with respect to SP2.

A fourth coil SP4, also having the length L3, is connected to the other end of third coil SP3 but is wound parallel to second coil SP2, so that its free end is adjacent the junction between SP2 and SP3. Coils SP2, SP3 and SP4 are preferably wound from one continuous piece of wire.

The free end of fourth coil SP4 is connected to a radiating element 13 which has a length L4 and is preferably a conductive layer on the end of dielectric rod 12.

The median wavelength of the predetermined frequency band, for which the antenna is intended to be used, is designated $\lambda$ or lambda. For example, for the 450–470 MHz band, the median wavelength would be the wavelength of the 460 MHz signal. The lengths L1 to L4 are preferably: $L1=\lambda/4$, $L2=\lambda/4$, $L3=\lambda/8$, and $L4=\frac{3}{8}\lambda$, so that the total length of rod-shaped antenna 10 is $\frac{7}{8}\lambda$.

Instead of a separate element for radiating element 13, one could use a conductive coating or a tubular foil, e.g copper foil.

FIG. 3 illustrates the mounting of rod-shaped antenna 10 on the roof 14 of, for example, an automobile chassis. Preferably, antenna 10 is releasably mounted in a base or mounting 15 which is securely connected to roof 14. The angle alpha of antenna 10 with respect to the vertical is preferably in the range 0° to 40°.

Various changes and modifications are possible within the scope of the inventive concept.

We claim:

1. Rod-shaped transceiver antenna for use in a predetermined frequency band, comprising a flexible, electrically conductive spring element (11), an elastic rod of dielectric material connected therewith, and a plurality of interconnected coils supported on said rod, wherein, defining $\lambda$ as the median wavelength of said predetermined frequency band, the flexible spring element (11), and a first coil (SP1) electrically connected therewith, collectively have a physical length $L1=\lambda/4$;

a second coil (SP2) is provided, having a physical length $\lambda/4$, and electrically connected to said first coil;

a third coil (SP3) is provided, having a physical length $\lambda/8$, and electrically connected to said second coil, said third coil being reverse-would with respect to said second coil; and a fourth coil (SP4) is provided, having a physical length $\lambda/8$, and electrically connected to said third coil and being wound parallel to said second coil (SP2), said fourth coil (SP4) being further connected to a radiating element (13) which has a physical length of $\frac{3}{8}\lambda$.

2. Rod-shaped antenna according to claim 1, further comprising a mounting (15) supporting said antenna (10) at an angle with respect to vertical in a range between 0° and 40°.

3. Rod-shaped antenna according to claim 1, wherein said radiating element (13) is a conductive layer formed on said elastic rod (12).

4. Rod-shaped antenna according to claim 2, wherein said radiating element (13) is a conductive layer formed on said elastic rod (12).

5. Rod-shaped antenna according to claim 1, wherein said radiating element (13) is a electrically conductive coating on said elastic rod.

6. Rod-shaped antenna according to claim 2, wherein said radiating element (13) is an electrically conductive coating on said elastic rod.

7. Rod-shaped antenna according to claim 1, wherein said radiating element (13) is an electrically conductive foil around said elastic rod.

8. Rod-shaped antenna according to claim 2, wherein said radiating element (13) is an electrically conductive foil around said elastic rod.

9. Rod-shaped antenna according to claim 1, wherein said elastic rod (12) comprises fiberglass, and tapers conically from a narrow portion at a free end of said antenna to a thicker portion adjacent the antenna's mounting.

10. Rod-shaped antenna according to claim 2, wherein said elastic rod (12) comprises fiberglass, and tapers conically from a narrow portion at a free end of said antenna to a thicker portion adjacent the antenna's mounting.

11. Rod-shaped antenna according to claim 3, wherein said elastic rod (12) comprises fiberglass, and tapers conically from a narrow portion at a free end of said antenna to a thicker portion adjacent the antenna's mounting.

12. Rod-shaped antenna according to claim 4, wherein said elastic rod (12) comprises fiberglass, and tapers conically from a narrow portion at a free end of said antenna to a thicker portion adjacent the antenna's mounting.

13. Rod-shaped antenna according to claim 5, wherein said elastic rod (12) comprises fiberglass, and tapers conically from a narrow portion at a free end of said antenna to a thicker portion adjacent the antenna's mounting.

14. Rod-shaped antenna according to claim 6, wherein said elastic rod (12) comprises fiberglass, and tapers conically from a narrow portion at a free end of said antenna to a thicker portion adjacent the antenna's mounting.

15. Rod-shaped antenna according to claim 7, wherein said elastic rod (12) comprises fiberglass, and tapers conically from a narrow portion at a free end of said antenna to a thicker portion adjacent the antenna's mounting.

16. Rod-shaped antenna according to claim 8, wherein said elastic rod (12) comprises fiberglass, and tapers conically from a narrow portion at a free end of said antenna to a thicker portion adjacent the antenna's mounting.

17. Rod-shaped antenna according to claim 1, further comprising an insulating layer surrounding said flexible spring element, all of said coils, and said radiating element (13).

18. Rod-shaped antenna according to claim 2, further comprising an insulating layer surrounding said flexible spring element, all of said coils, and said radiating element (13).

19. Rod-shaped antenna according to claim 3, further comprising an insulating layer surrounding said flexible spring element, all of said coils, and said radiating element (13).

20. Rod-shaped antenna according to claim 4, further comprising an insulating layer surrounding said flexible spring element, all of said coils, and said radiating element (13).

21. Rod-shaped antenna according to claim 5, further comprising an insulating layer surrounding said flexible spring element, all of said coils, and said radiating element (13).

22. Rod-shaped antenna according to claim 6, further comprising an insulating layer surrounding said flexible spring element, all of said coils, and said radiating element (13).

23. Rod-shaped antenna according to claim 7, further comprising an insulating layer surrounding said flexible spring element, all of said coils, and said radiating element (13).

24. Rod-shaped antenna according to claim 8, further comprising an insulating layer surrounding said flexible spring element, all of said coils, and said radiating element (13).

25. Rod-shaped antenna according to claim 9, further comprising an insulating layer surrounding said flexible spring element, all of said coils, and said radiating element (13).

26. Rod-shaped antenna according to claim 10, further comprising an insulating layer surrounding said flexible spring element, all of said coils, and said radiating element (13).

27. Rod-shaped antenna according to claim 11, further comprising an insulating layer surrounding said flexible spring element, all of said coils, and said radiating element (13).

28. Rod-shaped antenna according to claim 12, further comprising an insulating layer surrounding said flexible spring element, all of said coils, and said radiating element (13).

29. Rod-shaped antenna according to claim 1, wherein said second through fourth coils (SP2–SP4) form one continuous piece of wire.

* * * * *